United States Patent [19]

Fadda et al.

[11] 4,273,563

[45] Jun. 16, 1981

[54] COOLING SYSTEM FOR AN INTERNAL COMBUSTION ENGINE

[75] Inventors: Jean Fadda, Chassieu; Jean P. Pernet, Estrablin, both of France

[73] Assignee: Automobiles M. Berliet, Lyons, France

[21] Appl. No.: 959,910

[22] Filed: Nov. 13, 1978

[30] Foreign Application Priority Data

Nov. 10, 1977 [FR] France ..... 77 34522

[51] Int. Cl.[3] ..... B01D 53/24

[52] U.S. Cl. ..... 55/189; 55/204; 123/41.54; 210/512.1

[58] Field of Search ..... 55/42, 48, 52, 204, 55/205, 189, 191, 192; 123/41.15, 41.44, 41.48, 41.54; 210/512 R

[56] References Cited

U.S. PATENT DOCUMENTS 3,771,290 11/1973 Stethem ..... 55/205

FOREIGN PATENT DOCUMENTS 592709 2/1960 Canada ..... 210/512 R 2312645 1/1977 France ..... 123/41.54

*Primary Examiner*—Benoit Castel

*Assistant Examiner*—Richard W. Burks

*Attorney, Agent, or Firm*—Remy J. VanOphem

[57] ABSTRACT

The invention is an improved cooling system for an internal combustion engine wherein an expansion and degasification tank is placed in the cooling system allowing the liquid containing gases to enter the degasification portion of the tank tangentially thereby creating a swirling vortex flow of the coolant containing gases. The coolant is permitted to leave the degasification portion through a peripheral annular gap in the lower part of the tank created by a conical deflector which collects the gases in the coolant and is arranged so as to permit the gases to pass to the expansion of the tank. A check valve mounted in the outlet of the expansion tank prevents any backflow of liquid. Further, the gases are allowed to escape into the atmosphere through a pressure release valve mounted to the top portion of the expansion chamber. The expansion chamber and the degasification chamber may be separated so as to place the degasification chamber at any height in relation to the engine and the radiator without adversely affecting its function.

10 Claims, 5 Drawing Figures

COOLING SYSTEM FOR AN INTERNAL COMBUSTION ENGINE

BACKGROUND OF THE INVENTION

1. Field of the Invention

The present invention concerns an improved cooling system for an internal combustion engine.

2. Description of the Prior Art

The cooling systems of internal combustion engines which are found today on modern industrial vehicles almost all include systems ensuring both the degasification of the cooling liquid and the recovery of the liquid in an expansion tank.

Such systems are well known, for example by the application for a French patent made by the present applicant on May 28, 1975 with the number 75 16 888, in which an attempt was made to reduce the dimensions of the expansion tank to facilitate its installation on the vehicle.

In fact, it is well known that this is a major difficulty, especially in the case of vehicles with forward cabs. It is difficult to locate the degasification tanks above the level of the radiator.

SUMMARY OF THE INVENTION

The present invention aims at achieving an improved cooling system provided with a new, more effective, degasification tank which must no longer necessarily be installed above the level of the radiator.

An improved cooling system according to the invention comprises a degasification tank which receives from the upper part of the engine and the radiator the cooling liquid containing air and/or gas, and the bottom of which is connected to the inlet opening of the engine water pump, and it is characterised in that the entry opening for the cooling liquid is tangential in the expansion tank, the latter being lengthened vertically and having a form of revolution about a vertical axis, whilst a deflector is placed in the lower part of the degasification tank in such a way that the liquid can pass only between the wall of the tank and the circular rim of the deflector, the vortex created by the rotation of the liquid in the degasification tank carrying the concentration of the bubbles near to the axis of the said tank, the bubbles being extracted upwards in the direction of an expansion tank.

According to an additional characteristic of the invention, the wall which defines the top of the degasification tank is in the shape of a truncated cone tapering upwards, and carrying a central spring forming the outlet opening for gases.

According to an additional characteristic of the invention, the degasification tank is attached to an expansion tank placed directly above it, the two tanks forming a single assembly.

According to a variant of the invention, the degasification tank is located away from an expansion tank situated above it and to which it is connected by means of a channel.

According to an additional characteristic of the invention, the locations of the degasification and expansion tanks in relation to the engine and the radiator is immaterial.

According to an additional characteristic of the invention, a non-return valve is placed in the pipe connecting the bottom of the degasification tank to the water pump in order to allow the passage of the liquid only from the tank to the water pump.

According to an additional characteristic of the invention, the deflector situated in the bottom of the degasification tank is constituted by a conical wall tapering downwards.

According to an additional characteristic of the invention, the deflector is connected to the degasification tank by means of small plates arranged vertically around the vertical axis of the deflector, these plates being attached on the one hand to the lower surface of the deflector, and on the other hand being sleeved into a lower opening of the degasification tank, these plates allowing the swirling movement of the liquid to be stopped as it leaves the degasification tank.

According to an additional characteristic of the invention, the upper part of the expansion tank is attached to a cap fitted on the one hand with a depression valve which prevents the passage of the gases to the exterior, but allows air to enter freely to the interior, and on the other hand with a pressure valve, fitted in parallel with the depression valve, and which is calibrated to allow the gases in the expansion tank to escape only above a predetermined value of the internal pressure of the said tank.

According to an additional characteristic of the invention, the exhaust pipe of the engine has a branch to introduce compressed gases into the expansion tank, and this puts the latter under pressure.

According to a variant of the invention, in the case when the vehicle has a supercharged engine, the branch is taken off on the engine side of the supercharging turbocompressor.

According to another variant of the invention, in the case when the vehicle has a supercharged engine, the inlet pipe has a branch to introduce compressed air into the expansion tank.

BRIEF DESCRIPTION OF THE DRAWINGS

The attached drawing, given by way of non-limiting example, will allow the characteristics of the invention to be better understood.

DETAILED DESCRIPTION OF THE PREFERRED EMBODIMENT

Figure 1:
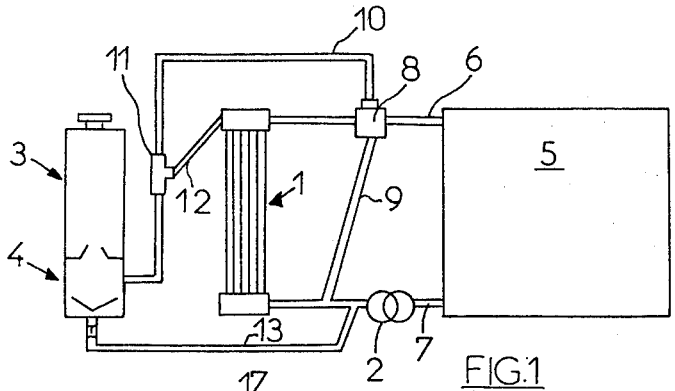
FIG. 1 is an overall schematic view of a cooling system according to the invention.

The cooling circuit according to the invention shown in FIG. 1 essentially comprises a radiator 1, a pump 2, an expansion tank 3 and a degasification tank 4.

The radiator 1 is connected to the engine 5 of the vehicle by means of an upper channel 6, and a lower channel 7 in which is fitted the pump 2 which insures the circulation of the cooling liquid. A thermostat 8, fitted in the upper channel 6, can divert a greater or smaller quantity of the liquid leaving the engine into a bypass channel 9 which ends in the lower channel 7, on the inlet side of the pump 2. In addition, part of the liquid which passes through the thermostat 8 flows into a loop channel 10 which ends in the degasification tank 4. The loop channel 10 passes through a T-junction which has the effect of an aspirator or venturi 11 connected to the top of the radiator 1 by a radiator channel 12. Finally a return channel 13 stretches between the bottom of the degasification tank 4 and the channel 7 to the inlet side of the pump 2.

Figure 2:
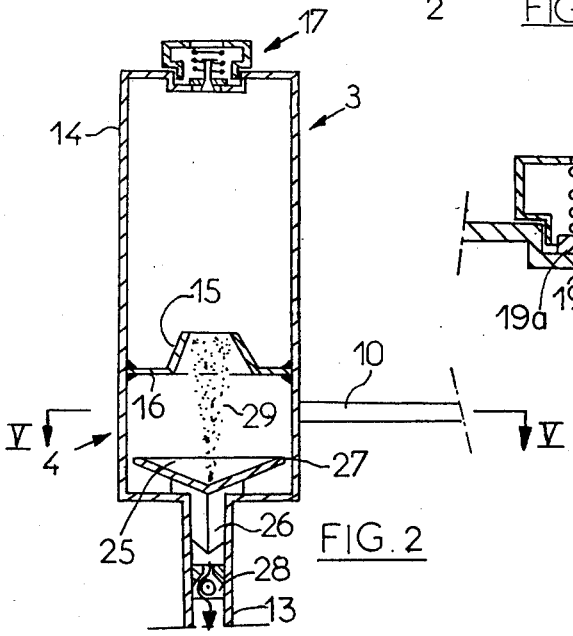
FIG. 2 is a view in axial section of the expansion and degasification tanks.

As shown in FIG. 2, the tanks 3 and 4 are brought together inside a single assembly comprising a cylindrical lateral wall 14 which is a cylinder of revolution about a vertical axis. An internal wall in the shape of a truncated cone tapering upwards 15 is attached internally to the wall 14 to separate the expansion tank 3 from the degasification tank 4 situated below it. This wall 15 has one or several holes 16 in its peripheral part, that is to say in its lower part. A cap 17 is fitted to the upper part of the expansion tank 3.

Figure 3:
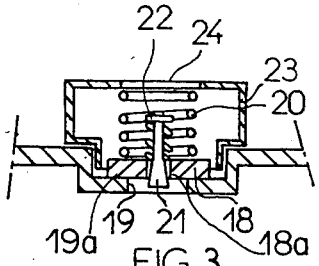
FIG. 3 is a part view to a larger scale of FIG. 2.
Figure 4:
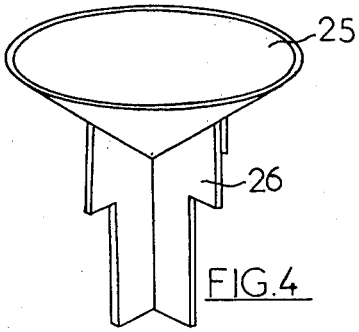
FIG. 4 is a perspective view of the lower deflector of the degasification tank.
Figure 5:
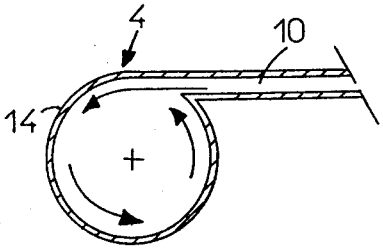
FIG. 5 is a section V—V (FIG. 2).

As may be seen in the detailed view in FIG. 3, the cap 17 is fitted with a pressure valve and a depression valve. The pressure valve comprises a blocking disc or valve body 18 constantly held against an opening 19 having a valve seat 19*a* in the tank 3 by a coil spring 20. This spring is calibrated so that the opening of the pressure valve takes place as soon as the internal pressure in the expansion tank 3 rises above a predetermined value. The depression valve comprises a blocking component or needle valve 21 which is able to slide in a hole central in the disc or valve body 18. The blocking valve 21 has on the one hand a flared lower end which is able to rest against the lower opening or valve seat 18*a* of the hole in the valve body 18, and on the other hand an upper stem around which is fitted a coil spring 22 so as to bring the flared end of the needle valve 21 against the valve body 18. The body 23 of the cap 17, against which the spring 20 bears, has an opening 24. As may be seen in the section in FIG. 5, the loop channel 10 joins the degasification tank 4 tangentially. In addition, the tank 4 incorporates, at its lower end, a deflector 25 constituted by a conical wall tapering downwards and fixed to the tank by means of small plates 26 (shown in FIG. 2). As may be seen in FIG. 4, the four plates 26 are arranged radially about the axis of the tank forming right angles between them so as to constitute a kind of cross-brace. The upper edge of the plates 26 is fixed to the lower surface of the deflector 25, whilst the lower part of the plates is fitted into the opening of the return channel 13. It will be noticed that an annular gap 27 is formed between the circular rim of the deflector 25 and the wall 14. The channel 13 also incorporates, near to the tank 4, a non-return valve 28 owing to which the cooling liquid can circulate only away from the degasification tank 4.

OPERATION

The operation is as follows:

The degasification tank 4 receives the cooling liquid containing air and gases coming from the upper part of the engine 5 and of the radiator 1. This liquid arrives through the loop channel 10 opening approximately half-way up and tangentially into the side of the tank 4. There results the appearance of a swirling current, or vortex, within the liquid contained in the degasification tank 4. This vortex causes an effective separation of the liquid and the gas because of the difference in their respective specific masses. The liquid tends to flow to the periphery under the effect of centrifugal forces, whilst the gas is concentrated near to the axis. Since the overall circulation is from top to bottom inside the tank 4, the degasified liquid passes below the deflector 25 through the gap 27.

The gas collected near to the axis appears in the form of a central eddy of bubbles 29 in the shape of a cone with the summit downward (FIG. 2). The shape of the separating wall 15 takes account of the vortex effect in such a way as to lead the bubbles towards the expansion tank 3. Bubbles subject to the Archimedean thrust move upwards of their own accord. The gas collects in the upper part of the expansion tank 3. Its pressure is limited by the calibrated pressure valve of the cap 17 described above.

In the lower part of the tank 4, the plates 26 not only serve to hold the deflector 25 in place, but also cause the swirling movement of the liquid to cease before it penetrates into the return channel 13. The non-return valve 28 avoids accidental back-flow of the liquid into the degasification tank 4. This back-flow tends to be produced on the stopping of the engine and the consequent stopping of the circulation of the liquid. When the mass of this engine is great, and especially if, the cylinder heads are cast iron, the reserve heat is large, and a few seconds after the engine stops, the cooling liquid starts to boil in the cylinder heads so that the vapor produced puts the liquid under pressure.

The holes 16 in the wall 15 allow total evacuation of the liquid by gravity when it is desired to drain the system.

The efficiency of the degasification tank 4 is such that the latter may be located at any height in relation to the engine 5 and the radiator 1, the only imperative being the relative positions of the tanks 3 and 4. The expansion tank 3 must be located above the degasification tank 4. However, the two tanks may equally well be connected together by means of a channel and be situated at a distance from each other.

According to a variant, compressed air, or more generally a compressed gas, may be introduced at the level of the cap 17 of the expansion tank 3 to increase the boiling point of the cooling liquid of the system.

For this, for example, a branch channel connecting the tank 3 to the exhaust pipe of the engine may be used. If a supercharged engine is in question, the branch channel should be connected to the engine side of the supercharger turbocompressor. In the latter case, a take-off from the inlet piping of the engine may also insure the pressurization of the cooling circuit in another way.

According to the value of the co-efficient of cubic expansion of the cooling liquid adopted and according to the particular characteristics of the system, the height of the degasification tank 4 may be approximately between a quarter or a third of the height of the expansion tank 3.

We claim:

1. In combination with an internal combustion cooling system of the type having a radiator mounted in front of an engine, including passage means communicating the hot cooling fluid containing gases from the engine to the radiator, the fluid being cooled in the radiator and returning to the engine by way of an inlet opening in the water pump mounted to said engine, the improvement comprising:

a cylindrical expansion tank mounted in said passage means for receiving said cooling liquid containing gases from said engine and from said radiator, said cylindrical expansion tank further comprising separator means mounted in said expansion tank defining a first chamber degasification portion and a second chamber expansion portion, said separator means further comprising:

an internal wall mounted transverse to the axis of said cylindrical expansion tank between said first chamber degasification portion and said second chamber expansion portion, said internal wall having portions defining a central opening and at least one hole spaced away from said central opening; and a truncated cone connected to said internal wall and covering said central opening, said cone having a wall tapering upwards from said internal wall;

inlet means tangentially mounted in said first chamber to said cylindrical expansion tank, said inlet means receiving said cooling liquid containing gases from said engine and from said radiator;

outlet means mounted to one end of said first chamber in the cylindrical expansion tank, said outlet means directing said cooling liquid contained in said tank to said passage means to return said cooling liquid to said engine;

valve means mounted to said outer end of said expansion tank in said second chamber for regulating the escape of gases contained in said cooling liquid;

conical deflector means mounted in said outlet means of the first chamber so that the cooling liquid containing gases enters said cylindrical expansion tank through said tangential inlet means and is caused to travel around the periphery of said cylindrical expansion tank thereby generating a vortex flow in said tank, said cooling liquid being able to pass around the peripheral conical edge of said deflector means such that the gases in said cooling liquid containing gases entering said tank are deflected by said deflector means toward said second chamber in said cylindrical tank; and means for mounting said cylindrical expansion tank in said passage means of said internal combustion engine cooling system.

2. The improvement as claimed in claim 1 further comprising:

means, mounted in said outlet means, for stopping said vortex flow movement of said cooling liquid such that the swirling movement of said cooling liquid is stopped as said cooling liquid flows out of said outlet means to said engine.

3. The improvement as claimed in claim 1 wherein said separator means further comprises means for mounting said expansion portion directly above said degasification portion so as to form a single tank assembly with a cylindrical outer wall.

4. The improvement as claimed in claim 1 wherein said separator means further comprises means for mounting said expansion portion above said degasification portion at a predetermined distance, said mounting means including passage means connecting said expansion portion to said degasification portion.

5. The improvement as claimed in claim 1 wherein said separator means further comprises means for mounting said degasification portion at any predetermined height relative to said engine and said radiator.

6. The improvement as claimed in claim 1 further comprising a check valve interposed between said passage means and said degasification portion of the expansion tank, said check valve permitting fluid flow communication between said expansion tank and said engine when fluid flow is in one direction, and terminating fluid flow communication when said fluid flow is in an opposite direction.

7. The improvement as claimed in claim 1 wherein said deflector means further comprises a deflector situated in the outlet means of the degasification portion, said deflector defined by a conical wall, tapering downwards, connected to the degasification portion by means of a plurality of small plates arranged radially around the vertical axis of the deflector, said plates being fixed at one end to the lower surface of the deflector, said plates further having vertical edges sleeved into said one end of the degasification tank, such that the swirling motion of the liquid is stopped as it leaves the degasification portion of the tank.

8. The improvement as claimed in claim 1, wherein said valve means further comprises a cap having a depression valve blocking the passage of gases towards the exterior of said tank, said cap further allowing the ambient air to enter freely into the interior of said tank through a pressure valve located parallel to said depression valve, said depression valve being calibrated so as to allow gases to leave the expansion tank only when the internal pressure of the said tank exceeds a predetermined value.

9. The improvement as claimed in claim 1 further comprising means for introducing compressed gases into the expansion tank such that said expansion tank is placed under pressure.

10. The improvement as claimed in claim 1 further comprising a branch passage to introduce compressed air into the expansion tank from said engine air inlet.

* * * * *

UNITED STATES PATENT OFFICE

CERTIFICATE OF CORRECTION

Patent No. 4,273,563 Dated June 16, 1981

Inventor(s) Jean Fadda

It is certified that error appears in the above-identified patent and that said Letters Patent are hereby corrected as shown below:

Column 3, line 3, after the words "and the" insert ----lower----.

Column 3, line 25, delete "blocking" and insert ----needle----.

Column 4, line 40, delete the word "to" and insert ----on----.

Signed and Sealed this

Sixth Day of October 1981

[SEAL]

*Attest:*

GERALD J. MOSSINGHOFF

*Attesting Officer*

*Commissioner of Patents and Trademarks*